US005628137A

United States Patent [19]

Cortese

[11] Patent Number: 5,628,137

[45] Date of Patent: May 13, 1997

[54] ADVANCED INDIVIDUAL COMBAT WEAPON

[75] Inventor: Robert A. Cortese, Philadelphia, Pa.

[73] Assignee: Cortese Armaments Consulting, Columbus, Ga.

[21] Appl. No.: 489,741

[22] Filed: Jun. 13, 1995

[51] Int. Cl.[6] ..... F41C 27/06

[52] U.S. Cl. ..... 42/105; 42/100

[58] Field of Search ..... 42/105, 100, 60, 42/103, 71, 50; 362/110; 33/241, 233; 244/3.27, 3.28, 3.29, 3.13; 89/33.02

[56] References Cited

U.S. PATENT DOCUMENTS

| | | | |
|---|---|---|---|
| H164 | 11/1986 | Savioli | 89/33.02 |
| 2,321,720 | 6/1943 | Whittaker | 42/50 |
| 2,421,752 | 6/1947 | Jones | 102/38 |
| 2,939,449 | 6/1960 | Kortick | 124/28 |
| 3,442,173 | 5/1969 | Muller | 89/127 |
| 3,444,778 | 5/1969 | Bates | 89/1.804 |
| 3,610,091 | 10/1971 | Bornand | 89/1 F |
| 3,620,162 | 11/1971 | King | 102/65.2 |
| 3,641,691 | 2/1972 | Ellis et al. | 42/1 F |
| 4,156,981 | 6/1979 | Lusk | 42/63 |
| 4,259,009 | 3/1981 | Jernigan | 356/1 |
| 4,302,796 | 11/1981 | Gustavson et al. | 362/62 |
| 4,579,298 | 4/1986 | Thomson | 244/3.21 |
| 4,667,899 | 5/1987 | Wedertz | 244/49 |
| 4,709,617 | 12/1987 | Anderson | 89/157 |
| 4,939,863 | 7/1990 | Alexander et al. | 42/103 |
| 5,004,183 | 4/1991 | Jarrett | 244/3.11 |
| 5,092,071 | 3/1992 | Moore | 42/85 |
| 5,198,600 | 3/1993 | E'Nama | 42/90 |
| 5,233,774 | 8/1993 | Leibowitz | 42/1.09 |
| 5,555,662 | 9/1996 | Teetzel | 42/103 |

*Primary Examiner*—Charles T. Jordan
*Assistant Examiner*—Meena Chelliah
*Attorney, Agent, or Firm*—Volpe and Koenig, PC

[57] ABSTRACT

An advanced individual combat weapon system provides a means of delivering a small warhead fired from a combat rifle over a range of at least 1200 meters with great accuracy and without a violent back blast. The delivery system is a small fin-stabilized, laser-guided solid propellant rocket with an integral control system for ignition and in-flight correction to the desired target. The target is acquired and illuminated by an infrared laser spot generated from a laser illuminator combined with an optical rangefinder mounted on the rifle. The firing of a small booster cartridge launches the rocket from a launch tube. The control system senses the reflected laser energy of the correct wavelength and corrects the flight based on the directional intensity of the reflected laser energy directed to the target.

14 Claims, 7 Drawing Sheets

ADVANCED INDIVIDUAL COMBAT WEAPON

BACKGROUND OF THE INVENTION

1. Field of the Invention

This invention relates to individual combat weapons including a small rocket delivery system. More particularly, the invention relates to a small laser-guided, flight-controlled rocket carrying an explosive warhead capable of being fired from a combat rifle.

2. Description of the Related Art

In order to provide the maximum in portable firepower for the United States Armed Services against its adversaries, the 40 mm, M203 grenade launcher became a standard complement to the Colt M16A2 carbine. The M203 was designed to fill the gap between a mortar and hand grenade by firing a spin-stabilized, anti-personnel grenade. This weapon is configured as a bolt-on, under barrel, rifled launcher capable of firing a wide range of fixed cartridge ammunition types. The M203 provides a means of delivering a fragmentation grenade with good accuracy to point targets at approximately 150 meters, and area targets to a maximum of approximately 400 meters. The grenade is armed 25 meters from the muzzle with a casualty radius of about 5 meters.

Previous to the use of grenade launchers was the rifle grenade. A specially configured grenade is placed over the barrel muzzle and a propellant cartridge loaded separately into the chamber. When fired, the special projectile provided the means for propelling the grenade downrange. Experience showed that the recoil effects and strain were too great on the rifle and that the lethal radius of the grenades could exceed their safe arming distance.

Both of these weapon systems have shown weaknesses in range and overall accuracy. It is therefore desired to have a weapon system capable of delivering a small warhead at a range greater than that previously achieved with the requisite accuracy.

SUMMARY OF THE INVENTION

The AICW (advanced individual combat weapon) system of the present invention provides a means of delivering a small warhead fired from a combat rifle over a range of at least 1200 meters with great accuracy and without a violent back blast. The delivery system is a small fin-stabilized, laser-guided solid propellant rocket with an integral control system for ignition and in-flight correction to the desired target. The target is acquired and illuminated by an infrared laser spot generated from a laser illuminator combined with an optical rangefinder mounted on the rifle. The firing of a small booster cartridge launches the rocket from a launch tube. The control system senses the reflected laser energy of the correct wavelength and corrects the flight based on the directional intensity of the reflected laser energy directed to the target.

Accordingly, it is an object of the present invention to provide a portable delivery system for accurately delivering a small explosive warhead to a desired target.

It is a further object of the invention to provide a small laser-guided rocket capable of being launched from a combat rifle with no backblast and with minimum recoil.

Other objects and advantages of the system will become apparent to those skilled in the art after reading the detailed description of the preferred embodiment.

DETAILED DESCRIPTION OF THE PREFERRED EMBODIMENT

Figure 1:
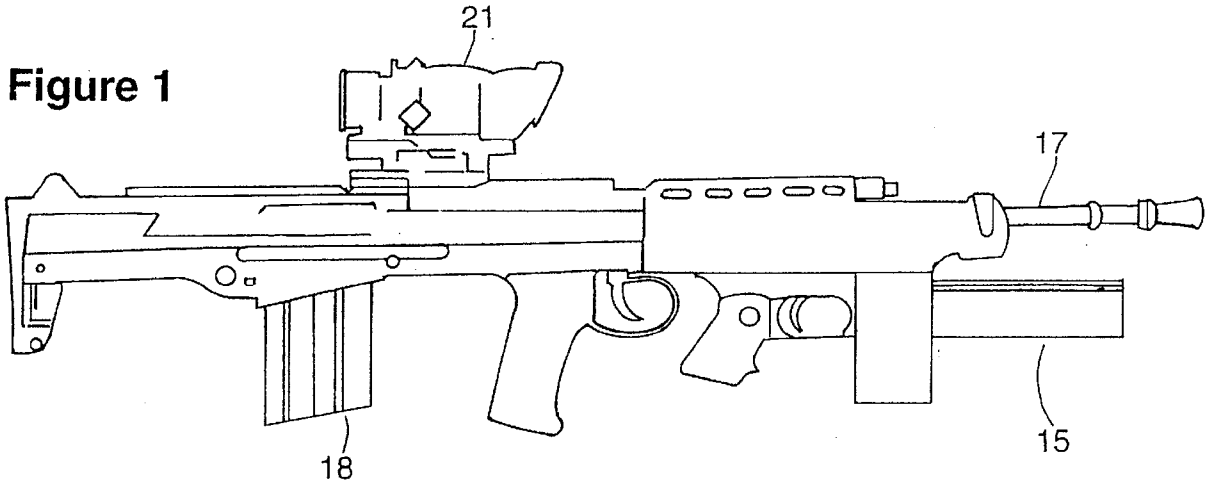
FIG. 1 is a view of the advanced individual combat weapon.

The preferred embodiment will be described with reference to the drawing figures where like numerals represent like elements throughout.

Figure 2:
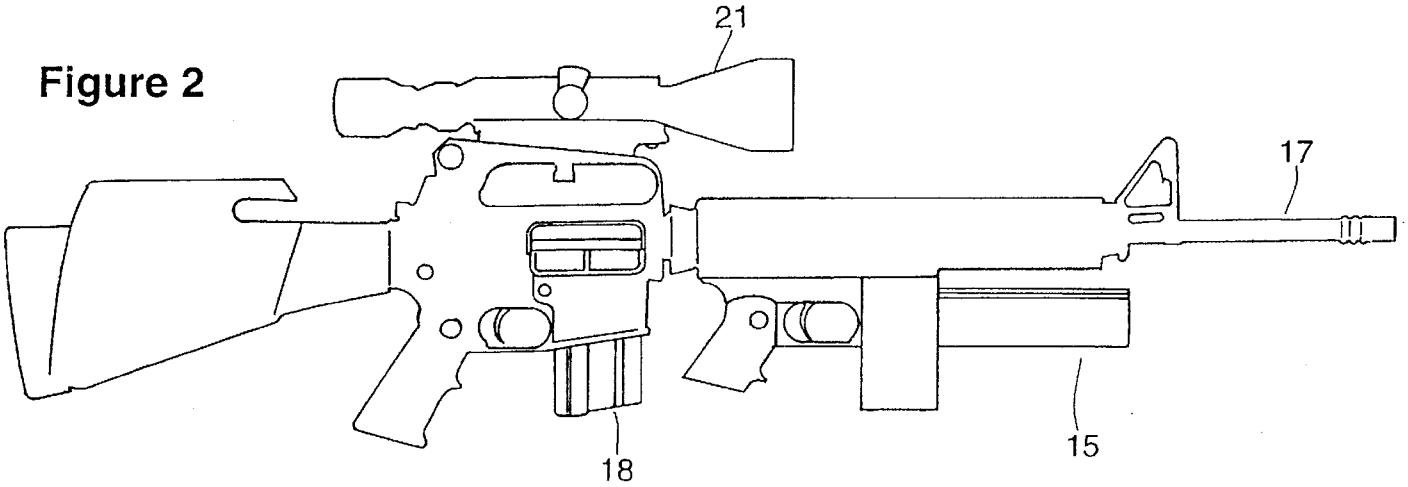
FIG. 2 is an alternative embodiment of the present invention.

In FIG. 1, the AICW 15 is shown mounted under the barrel of a fully automatic "bullpup" combat rifle 17, i.e. an 4.85 mm IW. Mounted onto the rifle 17 is a combination rangefinder and laser illuminator 21. An alternative embodiment using an M16A2 is shown in FIG. 2.

Figure 3:
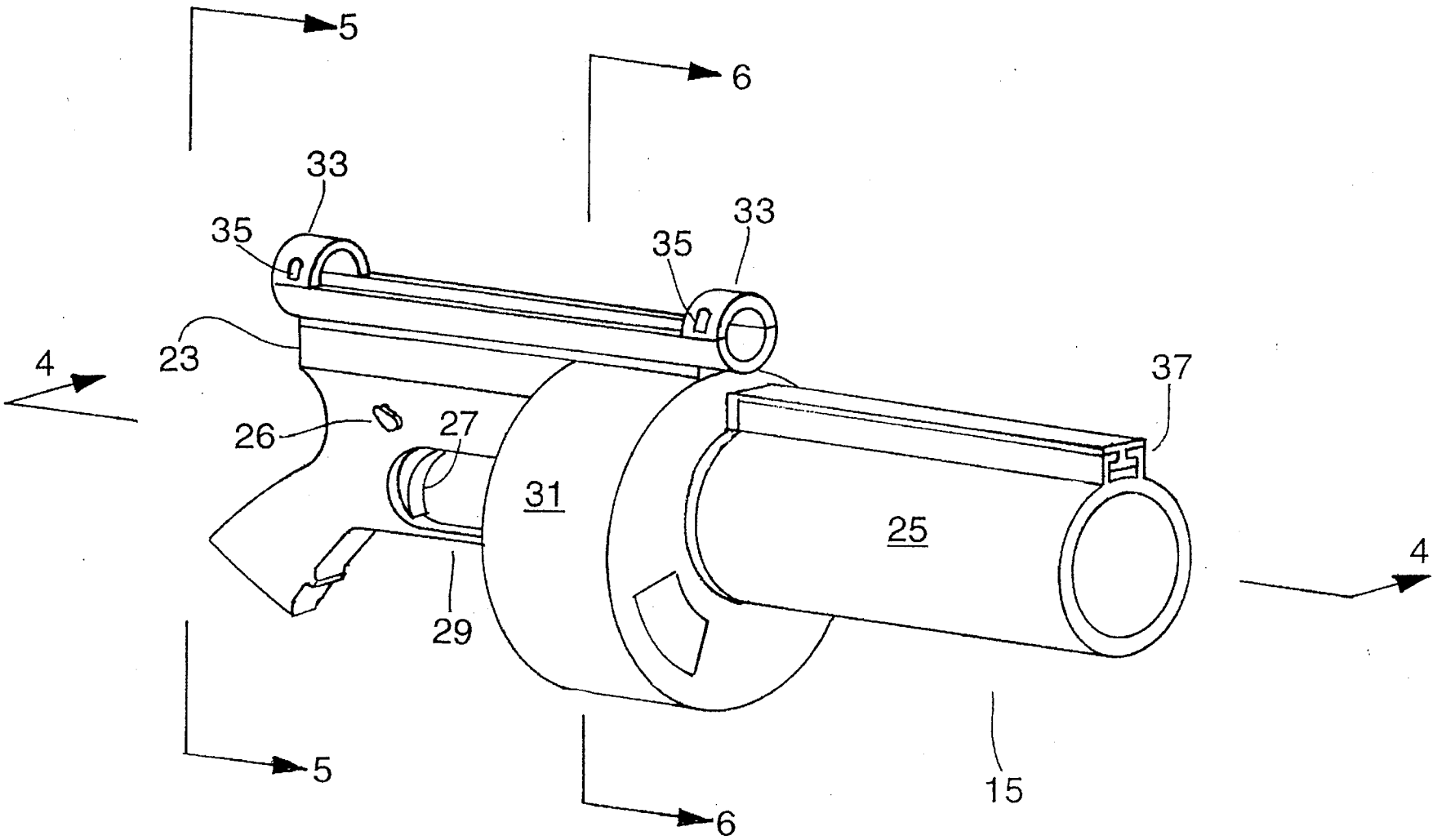
FIG. 3 is a perspective view of the present invention.

As shown in FIG. 3, the frame 23 of the AICW 15 is constructed of a milled lightweight aluminum alloy onto which the launch tube 25, trigger 27, trigger guard 29, booster cartridge magazine 31, and split clamp 33 are mounted thereon. The AICW 15 is mounted to the rifle 17 via a split clamp 33 capturing a portion of the barrel of the rifle 17 and secured with two bolts 35. The launch tube 25 is slidably disposed onto rails 37 integral with the frame 23.

Figure 4:
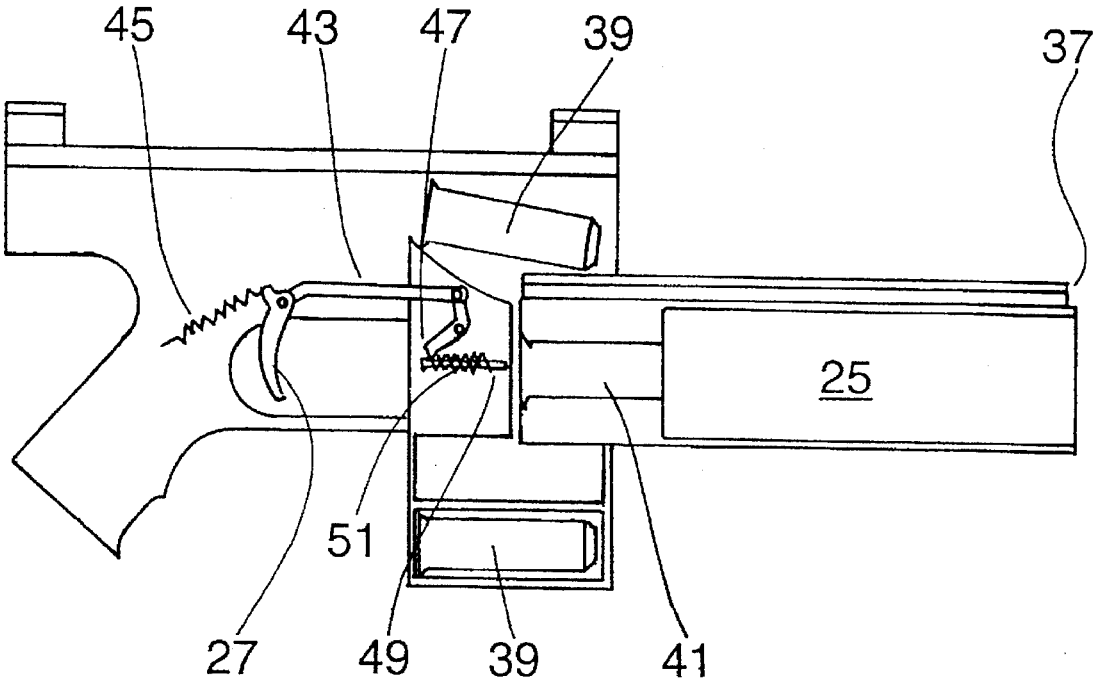
FIG. 4 shows a section view along lines 4—4 in FIG. 3.

As shown in FIG. 3 and 4, the slide rails 37 allow the launch tube 25 to slidably travel back-and-forth approximately 4 inches to cycle a fresh booster cartridge 39 into the firing chamber 41, extract a spent booster cartridge, and cock the trigger 27. A firing mechanism comprising a trigger 27 with trigger bar 43, trigger spring 45, connector 47, firing pin 49 and firing pin spring 51 are shown.

Figure 6:
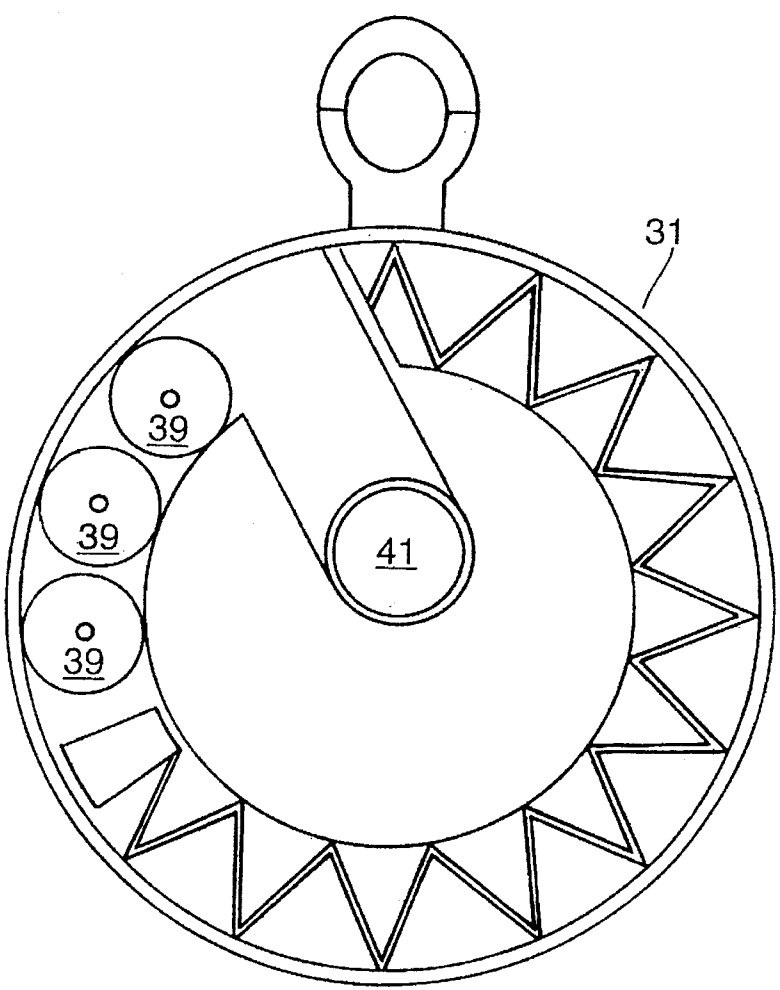
FIG. 6 shows a section view along lines 6—6 in FIG. 3.
Figure 5:
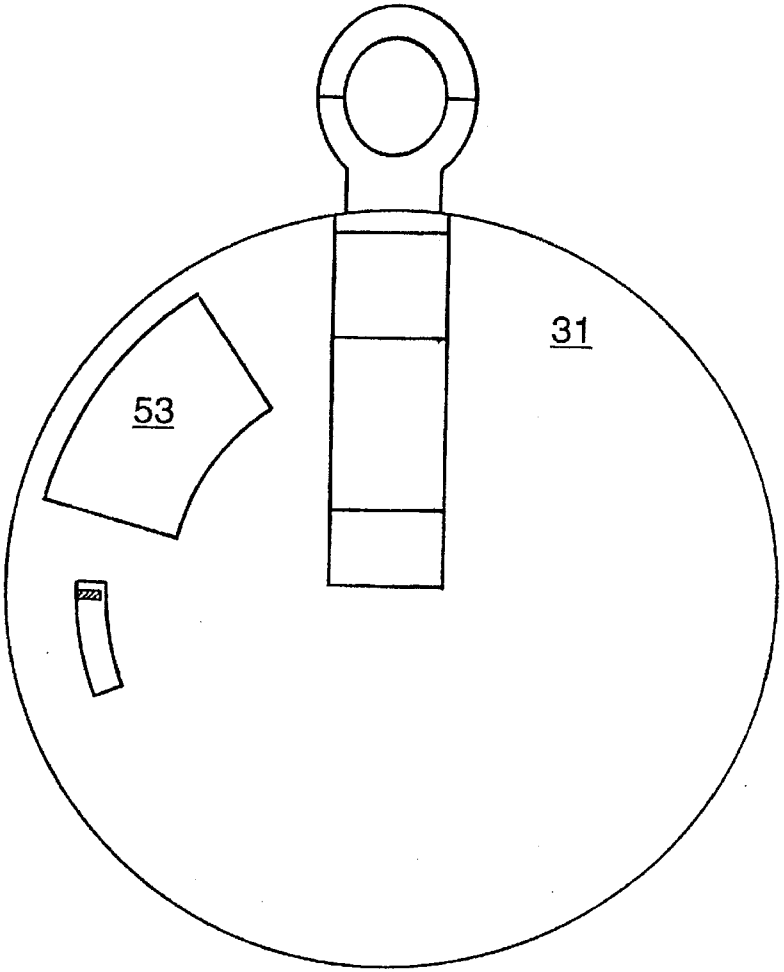
FIG. 5 shows a section view along lines 5—5 in FIG. 3.

As shown in FIGS. 5 and 6, fifteen booster cartridges 39 can be stored in the snail type magazine 31. Cartridges 39 are loaded into the magazine 31 through a covered port 53 located on the rear of the AICW 15. The operation of a snail type magazine 31 is well known in the art. An alternative embodiment uses a conventional, "clip" type removable magazine such as clip magazine 18 which supplies rounds to the rifle 17. Preferably such a magazine is capable of storing five booster cartridges 39.

Figure 7:
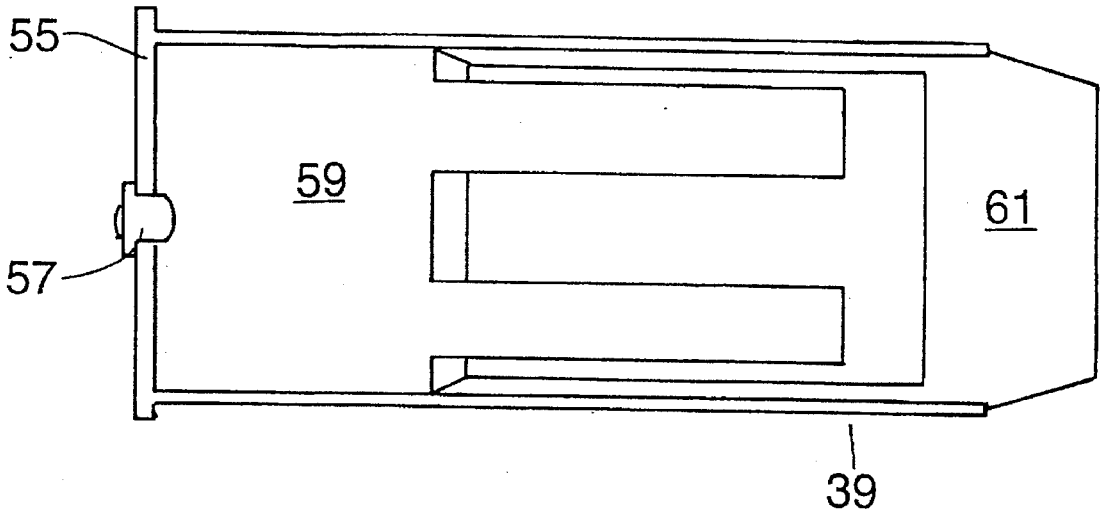
FIG. 7 shows a section view of the booster cartridge.

Referring to FIG. 7, the booster cartridge 39 is shown. The booster cartridge 39 comprises four components: 1) a case 55, 2) a primer 57, 3) a nitrocellulose propellant 59, and 4) an impact shroud 61. The booster cartridge 39 provides a preliminary propulsion means for the laser-guided rocket 63 to eliminate backblast and minimize recoil.

Figure 8:
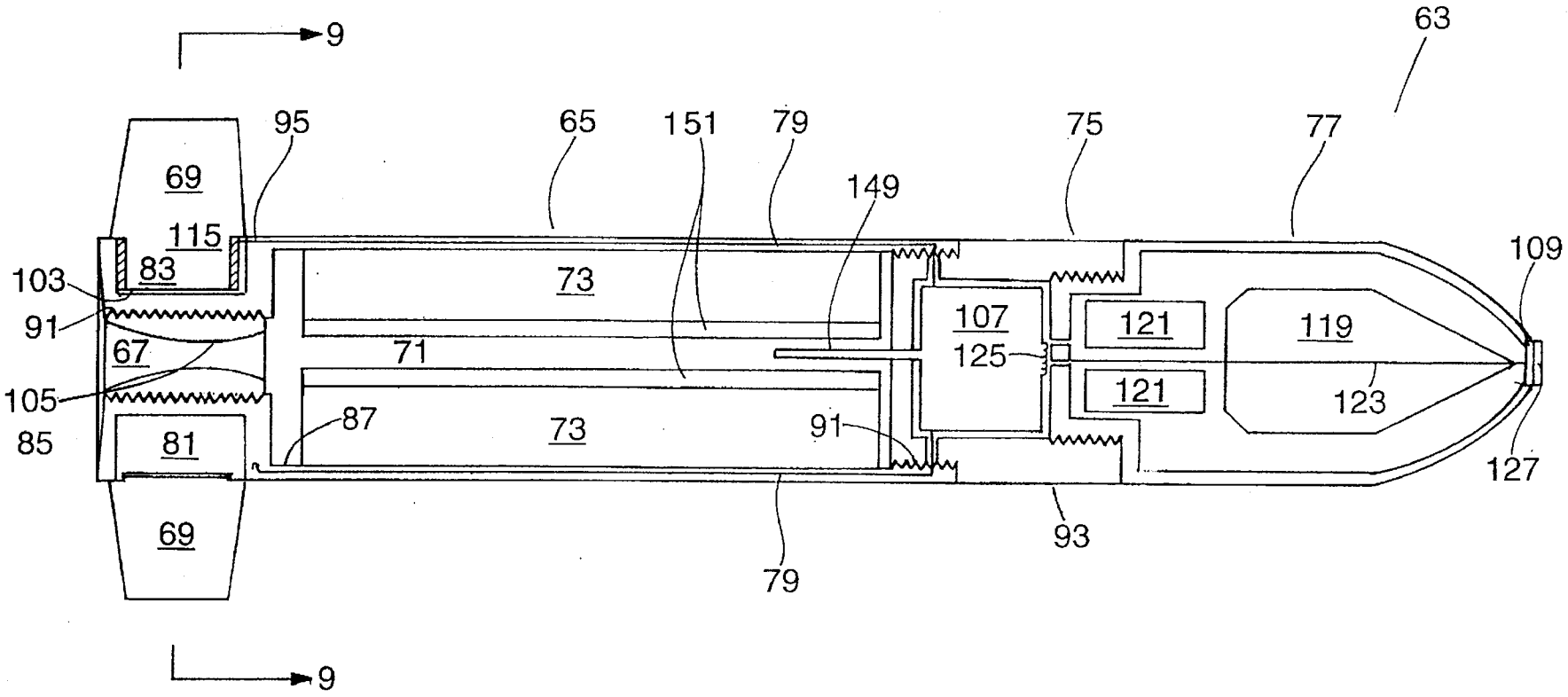
FIG. 8 shows a section view of the laser-guided rocket.

A miniature, laser-guided rocket 63 is shown in FIG. 8. The rocket 63 comprises a body 65, a nozzle 67, four guidance control fins 69, a central conduit 71, a charge 73, an electronics section 75, and a warhead 77. The overall length of the rocket 63 without warhead 77 is 8 inches. The rocket 63 diameter without the guidance fins deployed is 2.75 inches. The rocket 63 comprises an aluminum alloy body 65 cast in two parts. A lost wax or foam method is used to form four internal conduits 79 and solenoid wells 81 within the body 65 walls for routing control wires to the four fin 69 solenoids 83 located at the propulsion end 85. Both body 65 halves are friction welded together forming a unitary structure which is internally coated with a nickel-chromium intermetallic 87. The rocket body 65 is machined to form four fin actuating grooves 89 and threads 91 at the propulsion end 85 and flight control end 93.

Figure 9:
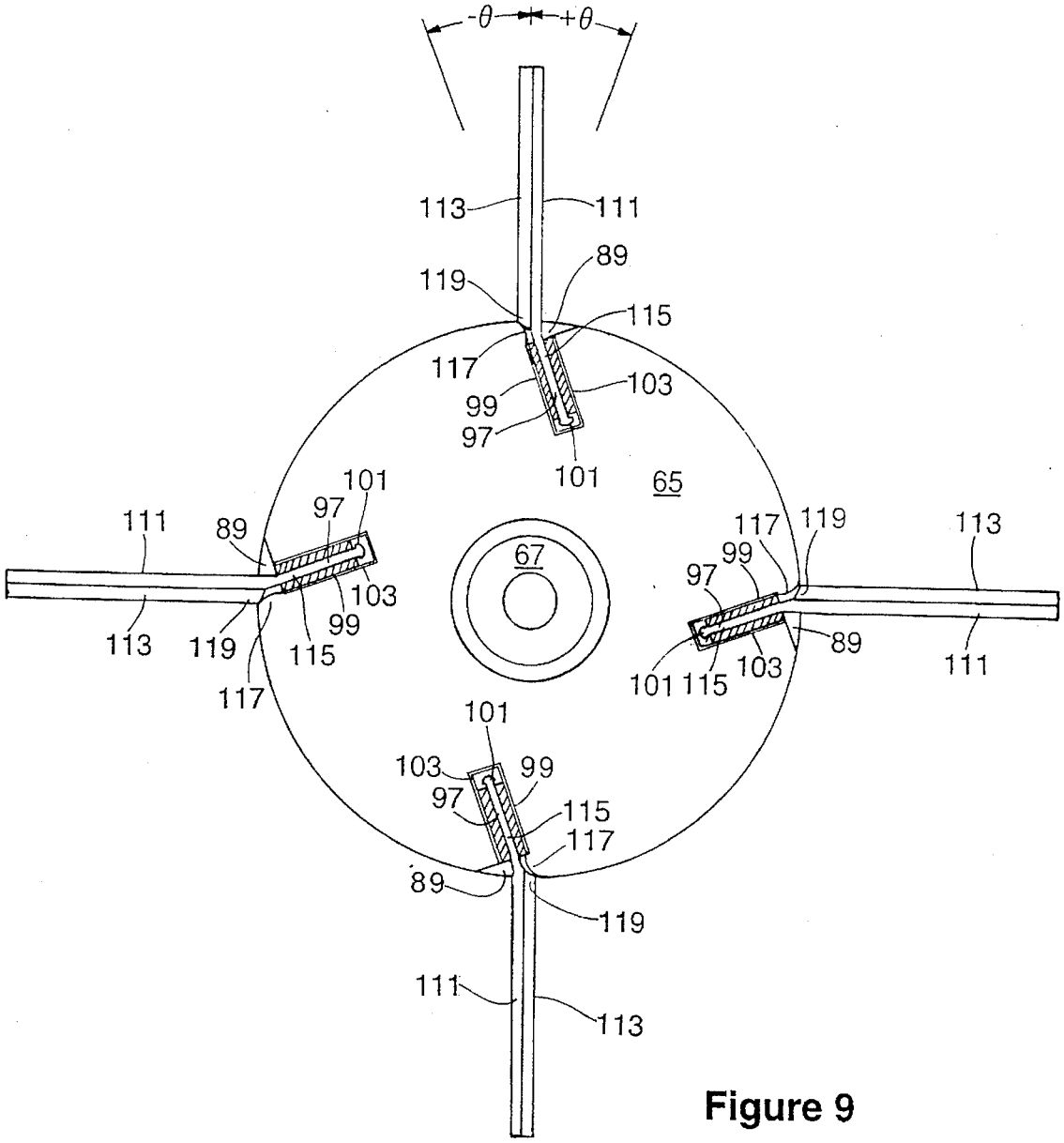
FIG. 9 shows a section view along lines 9—9 in FIG. 8.

Four miniature solenoids 83 with pig-tail leads 95 as shown in FIGS. 8 and 9 are press fit into each respective solenoid well 81. The pig-tail leads 95 run the length of the wire conduits 79 cast into the rocket body 65. The solenoids 83 are comprised of a magnetic riser 97 molded integral with the fin 69. Each riser 97 is surrounded by a high conductivity, precision wound coil 99. A flange 101 captures the riser 97 and restricts the length of fin 69 movement. Each solenoid 83 is conformally coated with a material comprising a refractory tungsten matrix 103 to provide thermal insulation.

A solid propellant charge or "grain" 73 in a liquefied state of measured volume is introduced into the rocket body 65. The body 65 is then centrifuged, bonding the propellant 73 to the body 65 while simultaneously forming the central conduit 71 internal to the rocket propellant 73. The shape of the central conduit 71 determines the surface area exposed to burning at any one time. The preferred embodiment produces a progressive thrust. As the period of burning continues, the area of the burning grain and the resultant thrust progressively increase.

The nozzle 67 is machined from a titanium alloy, in a subsonic cone profile 105 with shallow vent angles. The nozzle 67 is similarly coated with a nickel-chromium intermetallic 87. The nozzle 67 is threaded into the propulsion end 85 of the rocket body 65.

An electronics section 75 containing the flight correction electronics 107 is housed in an aluminum alloy structure approximately 2 inches in length. Threads are cut into both ends for receiving the forward end 93 of the rocket body 65 and warhead 77. One end of the electronics section 75 mechanically couples the electronics section 75 to the forward end 93 of the rocket body 65. The electronics section is selectively configured to pass the control wires 95 through to the internal electronics module 107. The other end of the electronics section 75 which mechanically couples the electronics section 75 to the warhead 77 is configured to electrically couple the electronics module 107 to a miniature four-quadrant photodetector array 109 located in the tip of the warhead 77.

As shown in FIG. 9 the four control fins 69 are of a laminar construction comprising a first, external layer 111 of a heat-resistant neoprene polymer with a modulus of elasticity (Young's modulus) of 40,000 psi, and a second, external layer 113 of a glass-reinforced Buna based rubber with a modulus of elasticity of 30,000 psi. Each fin 69 is attached to a fin actuating solenoid 83 utilizing a selectively configured tab 115 formed from an extension of the first layer 111 integrally with the riser 97 and flange 101. The natural elasticity of the first layer 111 provides a spring-like resiliency that maintains the precise geometry of the angular relationship of the fin 69 with the rocket body 65.

The fins 69 are pivoted along the axial direction by the fin tabs 115 and respective grooves 89. As shown in FIG. 9, the grooves 89 have a selective profile resembling that of a cam 117 on one slope. A base edge of the second external layer 113 acts as a cam follower 119. When the solenoids 83 are de-energized, the fins 69 assume a position −20° from normal. A command signal of 50% in conjunction with the mechanical camming action of the groove 89 and the elasticity of the fin material will move the fin 69 to a position normal to the rocket body 65. A command signal of 100% in conjunction with the mechanical camming action of the groove 89 will move the fin 69 +20° from normal. Immediately upon launch, the fins 69 deploy and assume an angle based upon the flight correction at that instant.

Returning to FIG. 8, the warhead 77 may be of different explosive compositions well known in the art depending upon the requirements, such as high explosive fragmentation, high explosive plastic 121 armor piercing 119, or flechettes. The four-quadrant photodetector 109 is mounted at the tip of the warhead 77 which is the means for detecting the reflected laser energy. The use of a quadrant detector 109 to determine the direction from which the laser energy is reflected is a well known technology to those skilled in this art. The detector 109 is a six lead device which must be electrically coupled to the electronics module 107 within the electronics section 75. The signal wires 123 are routed through the warhead 77 to a slip ring arrangement 125. An infrared transmitting lens and filter 127 overlay the surface of the detector 109. The filter 127 selectively passes those wavelengths of light energy sensitive to the detector 109.

Figure 10:
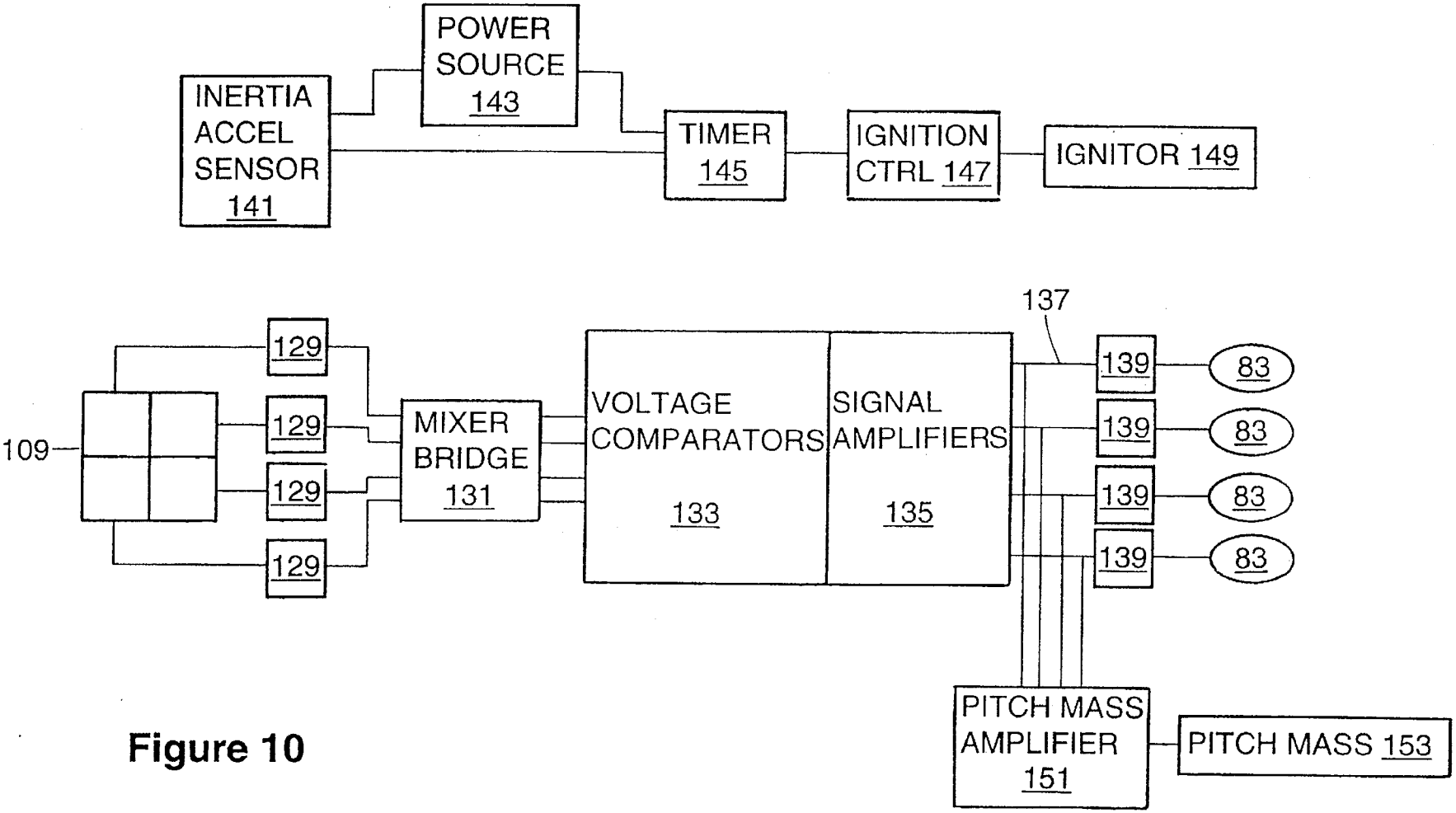
FIG. 10 shows a block diagram of the flight control system.

The flight control system is shown in FIG. 10. The flight control circuitry contains electronics combined with the aforementioned optics to generate signals for flight error correction when the current flight path does not terminate at the target. Laser energy falling on one quadrant of the photodetector 109 generates an output proportional to that energy. When the rocket is on-target, the laser energy detected on all four quadrants of the detector 109 is balanced, resulting in a balanced output and no course correction. When the rocket is off-target, the received laser energy is imbalanced and generates one or more directional error correction signals depending upon the difference between the optical center of the detector and the point source of the laser energy. In this manner, the rocket is in a continual state of correction with feedback in the form of constant re-vectoring of the rocket to the target.

The signals from the four quadrant photodetector 109 are output into signal preamplifiers 129 which preprocess and boost the signals. The signal preamplifiers 129 amplify the initial signal and also decode the reflected laser pulse.

The signals are input into a mixing bridge 131 where a high speed pulsed summing operation of adjacent pairs of photodetectors is performed to output four weighted signals proportional to the direction of the reflected laser energy. This operation is well known in the art. The mixer bridge 131 also filters the individual signals from excessive noise and interference.

The four signals are electrically coupled to a bank of voltage comparators 133 and amplifiers 135. Four control signals 137 define the error corrections that are passed onto the guidance fin solenoids 83 and pitch mass amplifier 151. The error correction signals are buffered and conditioned 139, then output to the fin control solenoids 83 to initiate horizontal flight correction.

Vertical flight corrections are made by utilizing a variable pitch mass 153. The pitch mass 153, moves forward or backward adjusting the atitude of the rocket in accordance with the error correction signals 137. The pitch mass 153 is calibrated for each type of warhead used.

The control system contains an inertia sensor 141 used to detect forward movement and energize the control system immediately after the booster cartridge 39 has been fired. The inertia sensor and accelerometer 141 latches and energizes the control system via a power source 143. A precision timer 145 counts down and signals an ignition control circuit 147 to detonate an ignitor 149 within the central conduit 71 of the rocket body 65. The ignitor 149 initiates a fast burn in conjunction with a sensitive outer layer 151 of the charge 73. The rocket 63 is guided by the control system as long as the initial trajectory is within the range of the target signal strength. If a target cannot be acquired or is lost during flight, the control system enters a fail-safe mode wherein a guidance fin 69 neutral position and assumes a ballistic trajectory.

In operation, AICW is used as follows: To load the rocket into the launch tube, the soldier must roll the flexible fins snugly against the rocket body and orient the top surface of the rocket with that of the launch tube prior to insertion. The soldier acquires a target using the rifle mounted scope and uses the rangefinder 21 to determine the distance to the target to ascertain whether the AICW 15 is within design range. The soldier then illuminates the target with the boresighted laser 21. After releasing the weapon safety 26, the soldier pulls the trigger 27, firing the booster cartridge 39. The booster cartridge 39 propels the rocket 63 out of the launch tube 25 approximately 30 meters without any backblast and with minimum recoil. The rocket flight control system 107 responds to the inertia, powers-on and ignites the rocket motor after a time delay coincident with an established acceleration such that the rocket is approximately 30 meters from the soldier upon ignition. At that point the fight control is active and the rocket is no longer on a ballistic trajectory. The rocket acquires the target if within the reflected laser energy and makes appropriate flight corrections until impact. If the rocket cannot acquire the reflected laser energy, the rocket assumes a ballistic trajectory based upon the last targeted correction.

Many modifications and variations of the present invention could be made without departing from the scope of the invention. The above description serves to illustrate and not limited in any way.

I claim:

1. An advanced individual combat weapon comprising:

a combat rifle having a frame with a barrel and a combination scope-rangefinder and laser illuminator mounted thereon;

a supplemental frame mounted under said rifle barrel;

a trigger means, a launch tube, and a booster cartridge chamber mounted to said supplemental frame such that said trigger means controls the firing of a booster cartridge disposed within the chamber; and a fin-stabilized, laser-guided rocket having an onboard flight control system disposed within said launch tube such that firing of a booster cartridge from said chamber launches said rocket.

2. A combat weapon according to claim 1 further comprising a booster cartridge magazine mounted to said supplemental frame for sequentially feeding booster cartridges into said booster cartridge chamber.

3. A combat weapon according to claim 2 wherein said booster cartridge magazine is of a snail type configuration holding more than 10 booster cartridges.

4. A combat weapon according to claim 2 wherein said booster cartridge magazine is of a clip type configuration holding more than 3 booster cartridges.

5. A combat weapon according to claim 1 wherein said combat rifle is of a conventional type.

6. A combat weapon according to claim 1 wherein said combat rifle is of a bullpup configuration.

7. A combat weapon according to claim 1 wherein said laser-guided rocket further comprises:

a body section, an electronics section and a warhead;

four flexible flight correction fins;

four miniature solenoids operatively associated with said guidance fins control;

said fins disposed in grooves in said body section;

said fins having a mounting edge selectively configured for insertion into said grooves;

said grooves having a selective contour in a cross section orientation such that said fins move in response to a camming action against said grooves such that said fins cant from normal in dependance upon an applied inwardly directed axial force;

said fins composed of two different materials having different coefficients of elasticity; and said fins mounted to said rocket body grooves movably disposed by said solenoids.

8. A combat weapon according to claim 7 wherein said inwardly directed axial force is applied by electrical energization of said solenoids.

9. A rocket launcher for used in conjunction with a combat rifle which has a frame with a barrel and a combination scope-rangefinder and laser illuminator mounted to the rifle frame, the rocket launcher comprising:

a supplemental frame mounted under said rifle barrel;

a trigger means, a launch tube, and a booster cartridge chamber mounted to said supplemental frame such that said trigger means controls the firing of a booster cartridge disposed within the chamber; and a fin-stabilized, laser-guided rocket having an on board flight control system disposed within said launch tube such that firing of a booster cartridge from said chamber launches said rocket.

10. A combat weapon according to claim 9 further comprising a booster cartridge magazine mounted to said supplemental frame for sequentially feeding booster cartridges into said booster cartridge chamber.

11. A combat weapon according to claim 10 wherein said booster cartridge magazine is of a snail type configuration holding more than 10 booster cartridges.

12. A combat weapon according to claim 10 wherein said booster cartridge magazine is of a clip type configuration holding more than 3 booster cartridges.

13. A combat weapon according to claim 9 wherein said laser-guided rocket further comprises:

a body section, an electronics section and a warhead;

four flexible flight correction fins;

four miniature solenoids operatively associated with said guidance fins control;

said fins disposed in grooves in said body section;

said fins having a mounting edge selectively configured for insertion into said grooves;

said grooves having a selective contour in a cross section orientation such that said fins move in response to a camming action against said grooves such that said fins cant from normal in dependance upon an applied inwardly directed axial force;

said fins composed of two different materials having different coefficients of elasticity; and said fins mounted to said rocket body grooves movably disposed by said solenoids.

14. A combat weapon according to claim 13 wherein said inwardly directed axial force is applied by electrical energization of said solenoids.

* * * * *